US012351357B2

(12) United States Patent
Xu et al.

(10) Patent No.: US 12,351,357 B2
(45) Date of Patent: Jul. 8, 2025

(54) INTEGRAL PULP-MOLDED BOTTLE, MOLD FOR MOLDING INTEGRAL PULP-MOLDED BOTTLE, APPARATUS AND PROCESS FOR PRODUCING INTEGRAL PULP-MOLDED BOTTLE

(71) Applicant: THE WING FAT PRINTING CO., LTD., Hong Kong (CN)

(72) Inventors: Kun Xu, Anyang (CN); Junzhong Chen, Anyang (CN); Guozhong Fei, Anyang (CN); Chao Shen, Anyang (CN); Huawei Zuo, Anyang (CN); Fujiao Liu, Anyang (CN); Shuangxi Xue, Anyang (CN); Guangde He, Anyang (CN)

(73) Assignee: THE WING FAT PRINTING CO., LTD., Hong Kong (CN)

( * ) Notice: Subject to any disclaimer, the term of this patent is extended or adjusted under 35 U.S.C. 154(b) by 245 days.

(21) Appl. No.: 17/793,932

(22) PCT Filed: May 17, 2021

(86) PCT No.: PCT/CN2021/094157

§ 371 (c)(1),
(2) Date: Jul. 20, 2022

(87) PCT Pub. No.: WO2021/228262

PCT Pub. Date: Nov. 18, 2021

(65) Prior Publication Data

US 2023/0055532 A1 Feb. 23, 2023

(30) Foreign Application Priority Data

May 15, 2020 (CN) ..... 202010414396.X
May 15, 2020 (CN) ..... 202010415313.9
(Continued)

(51) Int. Cl.
*B65D 1/02* (2006.01)
*D21J 3/10* (2006.01)

(52) U.S. Cl.
CPC ..... *B65D 1/0207* (2013.01); *D21J 3/10* (2013.01)

(58) Field of Classification Search
CPC .... B65D 1/0207; B65D 1/0215; B65D 23/02; B65D 23/102; D21J 3/10; D21J 3/07;
(Continued)

(56) References Cited

U.S. PATENT DOCUMENTS 2,961,043 A 11/1960 Hicks
6,521,085 B2 * 2/2003 Kumamoto ..... B65D 77/245 162/149
(Continued)

FOREIGN PATENT DOCUMENTS

CN 1263968 A 8/2000
CN 1299428 A 6/2001
(Continued)

*Primary Examiner* — Jose A Fortuna
(74) *Attorney, Agent, or Firm* — Bayramoglu Law Offices LLC

(57) ABSTRACT

A mold for molding an integral pulp-molded bottle shell includes a pulp suction system, an extrusion system, and a hot-press molding system. A process for producing the pulp-molded bottle shell by the mold includes: forming a wet bottle preform in a pulp suction cavity through the pulp suction system; controlling the moisture content and thickness of the wet bottle preform by extrusion of an elastomer bag of the extrusion system; and injecting a pressurized fluid through an elastomer bag in the hot-press molding system, and performing hot-press drying in conjunction with a lower hot-press mold. An apparatus and process for producing a pulp-molded bottle having a plastic liner are provided. The apparatus includes an area for molding a pulp-molded bottle shell, an area for cutting the pulp-molded bottle shell, an
(Continued)

area for storing a plastic bottle preform, and an area for performing loading of a liner.

15 Claims, 13 Drawing Sheets

(30) Foreign Application Priority Data

May 15, 2020 (CN) ..... 202010415315.8
May 15, 2020 (CN) ..... 202010415316.2

(58) Field of Classification Search
CPC .... D21J 3/04; D21J 7/00; B29C 49/24; B29C 2049/2404; B29K 2001/00; B29L 2031/7158
See application file for complete search history.

(56) References Cited

U.S. PATENT DOCUMENTS

| | | | | |
|---|---|---|---|---|
| 6,547,931 | B1 * | 4/2003 | Kumamoto | B65D 1/0207 162/219 |
| 6,841,041 | B2 * | 1/2005 | Kumamoto | D21J 7/00 162/227 |
| 7,048,975 | B1 * | 5/2006 | Tojo | B65D 1/0215 428/34.3 |
| 2003/0121635 | A1 * | 7/2003 | Kumamoto | D21J 3/10 162/227 |
| 2003/0145968 | A1 * | 8/2003 | Kumamoto | B65D 23/0821 162/227 |
| 2016/0145811 | A1 * | 5/2016 | Socci | D21J 3/10 162/217 |
| 2023/0055532 | A1 * | 2/2023 | Xu | D21J 3/10 |
| 2023/0226791 | A1 * | 7/2023 | Gough | B31B 50/62 493/98 |

FOREIGN PATENT DOCUMENTS

| | | | | | |
|---|---|---|---|---|---|
| CN | 1170035 | C | * | 10/2004 | D21J 3/10 |
| CN | 1840779 | A | | 10/2006 | |
| CN | 203652255 | U | | 6/2014 | |
| CN | 204416150 | U | | 6/2015 | |
| CN | 111593613 | A | | 8/2020 | |
| CN | 111593615 | A | | 8/2020 | |
| CN | 111593616 | A | | 8/2020 | |
| CN | 111593617 | A | | 8/2020 | |
| CN | 212611691 | U | | 2/2021 | |
| CN | 212611692 | U | | 2/2021 | |
| CN | 212611694 | U | | 2/2021 | |
| CN | 212611695 | U | | 2/2021 | |
| CN | 222024799 | U | * | 11/2024 | |
| EP | 1221413 | A1 | * | 7/2002 | B65D 1/0207 |
| JP | S54133972 | A | | 10/1979 | |
| KR | 20020028926 | A | | 4/2002 | |
| WO | WO-2013192260 | A1 | * | 12/2013 | D21J 3/10 |
| WO | WO-2016081614 | A1 | * | 5/2016 | D21J 3/10 |
| WO | 2019034704 | A1 | | 2/2019 | |

* cited by examiner

INTEGRAL PULP-MOLDED BOTTLE, MOLD FOR MOLDING INTEGRAL PULP-MOLDED BOTTLE, APPARATUS AND PROCESS FOR PRODUCING INTEGRAL PULP-MOLDED BOTTLE

CROSS REFERENCE TO THE RELATED APPLICATIONS

This application is the national phase entry of International Application No. PCT/CN2021/094157, filed on May 17, 2021, which is based upon and claims priority to Chinese Patent Applications No. 202010414396.X, filed on May 15, 2020; No. 202010415313.9, filed on May 15, 2020; No. 202010415316.2, filed on May 15, 2020; and No. 202010415315.8, filed on May 15, 2020, the entire contents of which are incorporated herein by reference.

TECHNICAL FIELD

The present disclosure relates to the technical field of molding pulp-molded products, and particularly relates to a mold for molding an integral pulp-molded bottle, an apparatus and process for producing an integral pulp-molded bottle, and development of a product.

BACKGROUND

Since the era of industrialization, plastic products have been widely used in daily life. By virtue of quite low production costs, plastic packaging materials have a higher rate of increase in the world market compared with other packaging materials. Plastics as non-degradable materials cause pollution to many environments, resulting in low recycling value, impacts on agricultural development, threats to animal survival, occupation of land resources, release of toxic substances, and so on. Many countries prohibit the use of the plastics. China issued another ban on plastics in 2020. Thus, reduction and even prohibition on the use of the plastics have become the current direction of packaging design.

The existing process of pulp-molded bottle products is as follows: two half parts of a bottle are bonded by means of glue after being molded, or a pulp-molded tube is bonded with a bottle mouth and a bottle bottom. The existing process includes molding, glue spreading, pressing, and trimming. For example, a pulp-molded bottle disclosed by Chinese patent CN201320746431 includes a bottle body and a plastic end located on the upper part of the bottle body, where the bottle body is formed from a pulp-molded tube open upwards, and the lower edge of the plastic end is closely combined with the opening of the pulp-molded tube, such that the cavity of the pulp-molded tube is closed. A liquid storage bottle having a connecting ring disclosed by Chinese patent CN 201420833805 includes a pulp-molded bottle body, where a liner for storing liquid is arranged in the pulp-molded bottle body. The pulp-molded bottle body includes a first half cavity and a second half cavity which are arranged face to face; the first half cavity is in butt joint with the second half cavity, such that a cavity accommodating the liner is formed; and the first half cavity and the second half cavity are fixedly connected through the connecting ring. The existing process has a long course, is complicated and costly, and affords poor environmental protection caused by difficulty in degradation of glue. In order to reduce the cost of the pulp-molded bottles and improve environmental protection to meet the environmental requirements, the present disclosure provides a process for molding integral pulp-molded bottles. The process for molding integral pulp-molded bottles provided by the present disclosure merely has two steps of molding and trimming and omits the glue spreading, the pressing, and the like, thus greatly improving the environmental protection performance of products and reducing the cost of the pulp-molded bottles. Therefore, this process is suitable for wide popularization.

Various fiber materials are adopted as raw materials of pulp molding. Therefore, the raw materials have a wide range of sources and are easy to collect without affecting environment protection and recycling, thus having excellent environmental protection performance and outstanding formability of the pulp molding. Because a production process of the raw materials relies on the development of molds, the raw materials can be made to form a variety of shapes as required. However, due to own property, the paper is quickly wetted and loses its function after making contact with liquid. In view of this, how to reduce the use of the plastics for the achievement of the environmental requirements and enable bottles to store the liquid for a long time are the focus of the development of the present disclosure.

SUMMARY

In order to solve the above problems, an elastomer material having high temperature resistance and high pressure resistance is used in the design of a pulp molding mold, and a plastic liner is combined with a pulp-molded bottle shell by blow molding to improve the production mode of the existing pulp molding structure. Thus, the present disclosure reduces the use of plastics and enables the bottle to be capable of storing liquid for a long time.

A novel pulp injection process performed in the bottle is adopted to fulfill a pulp suction process of the bottle, and the pulp molding mold adopting a new type elastomer includes an extrusion die and an upper hot-press mold as a whole. Thus, a plastic layer needs to be added in the pulp-molded bottle for storage of the liquid in the pulp-molded bottle. The present disclosure specifically adopts the following technical solutions.

A mold for molding an integral pulp-molded bottle includes a pulp suction system, an extrusion system, and a hot-press molding system. The pulp suction system is used to preliminarily form a wet bottle preform by pulp injection, and mold, by vacuum pumping, the wet bottle preform preliminarily formed by the pulp injection into a wet bottle preform subjected to pulp suction. The extrusion system is used to form a premolded pulp-molded bottle by extrusion of an elastomer bag. The hot-press molding system is used to form an integral pulp-molded bottle by the extrusion of the elastomer bag.

Specifically, the pulp suction system includes a pulp injection mold plate, a pulp injection cavity, and a pulp suction mold plate, where the pulp suction mold plate is provided with a cavity that has the same as a bottle in shape. The pulp injection mold plate is located above the cavity and connected to the pulp injection cavity. The pulp injection cavity has an extension portion, the extension portion is provided with pulp injection orifices, the extension portion extends into the cavity of the pulp suction mold plate, and the wet bottle preform is preliminarily formed by injecting pulp via the pulp injection orifices. The pulp suction mold plate is provided with pulp suction holes and a pulp suction cavity; the pulp suction holes are formed in a peripheral surface of the cavity and communicate with the pulp suction cavity. The pulp suction cavity is connected to vacuum equipment, so as to mold, by the vacuum pumping, the wet bottle preform preliminarily formed by the pulp injection into the wet bottle preform subjected to the pulp suction.

Further, the pulp injection cavity communicates with a pulp pool, and the pulp may be selected from sugarcane pulp, bamboo pulp, wood pulp, or the like.

Further, the pulp injection orifices are evenly distributed in the extension portion.

Further, a pulp supplementing device is further configured to perform pulp supplementation in a case where the wet bottle preform preliminarily formed by injecting the pulp via the pulp injection orifices has a part with uneven pulp.

Specifically, a bottle cavity is formed by the pulp injection mold plate and the pulp suction mold plate; and the pulp suction mold plate is composed of half pulp suction mold plates.

More specifically, the pulp suction holes in the peripheral surface of the cavity respectively correspond to a bottle mouth part, a bottleneck part, a bottle body part, and a bottle bottom part of the bottle cavity. The pulp suction holes at the bottle mouth part, the pulp suction holes at the bottleneck part, and the pulp suction holes at the bottle body part are higher in density than the pulp suction holes at the bottle bottom part.

The extrusion system is composed of an extrusion die, a pressurizing cavity, an elastomer bag, the pulp suction mold, and the wet bottle preform subjected to the pulp suction. The pressurizing cavity is formed in the extrusion die and connected to the elastomer bag. A bottle cavity is formed by the extrusion die and the pulp suction mold below the extrusion die. The wet bottle preform subjected to the pulp suction is stored in the bottle cavity. The elastomer bag extends into the wet bottle preform stored in the bottle cavity. In a mold closing state, the elastomer bag is expanded by being pressurized to extrude the wet bottle preform to be attached to an inner wall of the bottle cavity to form a premolded pulp-molded bottle.

Further, the elastomer bag is filled with high-pressure air, water, or oil to be pressurized, so as to apply a pressure to an inner cavity of the wet bottle preform subjected to the pulp suction for dewatering and premolding.

Specifically, a bottle cavity is formed by the extrusion die and the pulp suction mold; and the pulp suction mold is composed of half pulp suction molds.

The hot-press molding system is composed of an upper hot-press mold, a pressurizing cavity, an elastomer bag, a lower hot-press mold, and the premolded pulp-molded bottle. The pressurizing cavity is formed in the upper hot-press mold and connected to the elastomer bag. A bottle cavity is formed by the upper hot-press mold and the lower hot-press mold below the upper hot-press mold. The premolded pulp-molded bottle is stored in the bottle cavity; the elastomer bag extends into the premolded pulp-molded bottle stored in the bottle cavity. In a mold closing state, the elastomer bag is expanded by being pressurized to extrude the premolded pulp-molded bottle to be attached to an inner wall of the bottle cavity to form an integral pulp-molded bottle.

Further, the elastomer bag is filled with high-pressure air, water, or oil to be pressurized, so as to extrude an inner cavity of the premolded pulp-molded bottle for dewatering and molding. In this way, a pulp-molded bottle preform is completely molded.

Specifically, the bottle cavity is formed by the upper hot-press mold and the lower hot-press mold, and the lower hot-press mold is composed of a bottle body part and a bottle bottom part.

The lower hot-press mold is made from a breathable material and can be polished, so as to rapidly eliminate water vapors generated due to high temperature for rapid drying of a product. Specifically, the hot-press mold is made from breathable steel. Micropores in the breathable steel can absorb the water vapors to achieve rapid elimination of the water vapors.

The elastomer bag is made from a material having high pressure resistance and high temperature resistance. The elastomer bag in the extrusion system and the elastomer bag in the hot-press molding system may be the same or different.

The hot-press molding system is provided with a hot-press device used to heat and pressurize the hot-press molding system.

A process for producing the integral pulp-molded bottle by means of the mold includes the following steps:

(1) assembling the pulp suction system to make the pulp suction system be in a mold closing state and injecting pulp to the bottle cavity from the pulp injection cavity via the pulp injection orifices in the extension portion to achieve sufficiency and evenness of the pulp in the bottle cavity; where the pulp may be injected by spraying, pouring, suction in a mixing manner in the bottle, or throwing with a drum; and if the part with uneven pulp exists, the pulp supplementation is performed by the pulp supplementing device;

(2) starting the vacuum equipment to perform the vacuum pumping in the pulp suction cavity to make the pulp be evenly attached to a surface of the pulp suction mold to form the wet bottle preform subjected to the pulp suction; where the vacuum pumping is performed to specifically control the moisture content of the wet bottle preform to be 70%-80% and the thickness of the wet bottle preform to be about 2.5 mm;

(3) transferring the wet bottle preform subjected to the pulp suction to the extrusion system, and storing the wet bottle preform subjected to the pulp suction into the bottle cavity; enabling the elastomer bag to extend into the wet bottle preform stored in the bottle cavity; in the mold closing state, expanding the elastomer bag by pressurization to make the elastomer bag extrude the wet bottle preform to be attached to the inner wall of the bottle cavity to form the premolded pulp-molded bottle; and after the molding is completed, taking out the elastomer bag after pressurized air or liquid in the elastomer bag is released or discharged; where the pressure from the elastomer bag is controlled to be 1 kgf, so that the moisture content of the premolded pulp-molded bottle is 40%-50%, and the thickness of the premolded pulp-molded bottle is 1.5 mm; and the elastomer bag can provide different pressures according to different requirements of products; and (4) transferring the premolded pulp-molded bottle to the hot-press molding system, and storing the premolded pulp-molded bottle into the bottle cavity; enabling the elastomer bag to extend into the premolded pulp-molded bottle stored in the bottle cavity; in the mold closing state, expanding the elastomer bag by pressurization to make the elastomer bag extrude the premolded pulp-molded bottle to be attached to the inner wall of the bottle cavity to form the integral pulp-molded bottle by hot-press molding; and after the molding is completed, taking out the elastomer bag after pressurized air or liquid in the elastomer bag is released or discharged; where the products having different thicknesses have different moisture contents; for example, a finished product having a thickness of about 1.0 mm has a moisture content of 3%-5%; and the hot-press molding system is heated to 150° C. by the hot-press mold; and the pressure from the elastomer bag is about 5 kgf and can be adjusted according to different requirements of the products.

In order to reduce the use of plastics and enable the bottle to be capable of storing liquid for a long time, the present disclosure provides an apparatus for producing a pulp-molded bottle having a plastic liner. The apparatus can fulfill molding of a pulp-molded bottle shell and loading of a liner. Specifically, the apparatus includes an area for molding the pulp-molded bottle shell, an area for cutting the pulp-molded bottle shell, an area for a plastic bottle preform, and an area for loading of a liner. The area for molding the pulp-molded bottle shell includes the pulp suction system, the extrusion system, and the hot-press molding system. After the molding is completed, an integral pulp-molded bottle shell is formed. A pulp-molded bottle having a standard size is cut in the area for cutting the pulp-molded bottle shell and combined with a plastic liner in the area for the loading of the liner; and finally, the integral pulp-molded bottle is obtained.

An elastomer component controlled by a pressure pump and high temperature liquid is used in a hot-press molding area to extend into the pulp-molded bottle shell for drying and shaping. An external part of the pulp-molded bottle shell is influenced by the hot-press mold, and the hot-press mold eliminates the water vapors and provides high temperature to perform drying and shaping on the external part of the pulp-molded bottle shell.

The size of the pulp-molded bottle shell is normalized in the area for cutting the pulp-molded bottle shell, so that the pulp-molded bottle shell with a uniform specification is obtained.

The premolded bottle preform in the area for the plastic bottle preform is conveyed to the area for the loading of the liner for processing.

In the area for the loading of the liner, the pulp-molded bottle shell is located in a blow mold. When the plastic bottle preform is put into the blow mold by a blow molding head for processing, the plastic bottle preform can be directly attached in the pulp-molded bottle shell.

The present disclosure further provides a process for producing a pulp-molded bottle having a plastic liner. The process includes the following steps: making the integral pulp-molded bottle; premolding a plastic bottle preform in an area for the plastic bottle preform; and in an area for loading of a liner, storing the integral pulp-molded bottle into a blow mold. When the plastic bottle preform is put into the blow mold by a blow molding head for blow molding, the plastic bottle preform can be directly attached in a pulp-molded bottle shell.

The pulp-molded bottle made by the present disclosure has the following structure: the pulp-molded bottle shell is made of 100% pulp-molded products to achieve excellent support strength, and the liner is made of 0.1-0.05 mm thick plastics to protect liquid and achieve safety (in the fields of foods, daily chemicals, and the like), so that the problem of liquid penetration caused by paper is solved, and the plastics are reduced by more than 70%. Thus, contributions to environmental protection and plastic reduction are made.

BRIEF DESCRIPTION OF THE DRAWINGS

FIG. 1A shows the structural diagram of the pulp injection system in a mold opening state of the present disclosure.

FIG. 1B shows the structural diagram of the pulp injection system in a mold closing state of the present disclosure.

FIG. 2A shows the structural diagram of the pulp suction system in a mold opening state of the present disclosure.

FIG. 2B shows the structural diagram of the pulp suction system in a mold closing state of the present disclosure.

FIG. 3A shows the structural diagram of the hot-press molding system in a mold opening state of the present disclosure.

FIG. 3B shows the structural diagram of the hot-press molding system in a mold closing state of the present disclosure.

FIG. 12A shows the pressure test on an empty bottle, FIG. 12B shows the empty bottle subjected to the pressure test, and FIG. 12C shows a curve of the pressure test on the empty bottle.

FIG. 13A shows the pressure test on a water-filled bottle, FIG. 13B shows the water-filled bottle subjected to the pressure test, and FIG. 13C shows a curve of the pressure test on the water-filled bottle.

DETAILED DESCRIPTION OF THE EMBODIMENTS

The present disclosure will be further described below in conjunction with FIG. 1A-FIG. 3B, FIG. 4-FIG. 11, and specific embodiments 1-5.

Embodiment 1

Figure 1A:
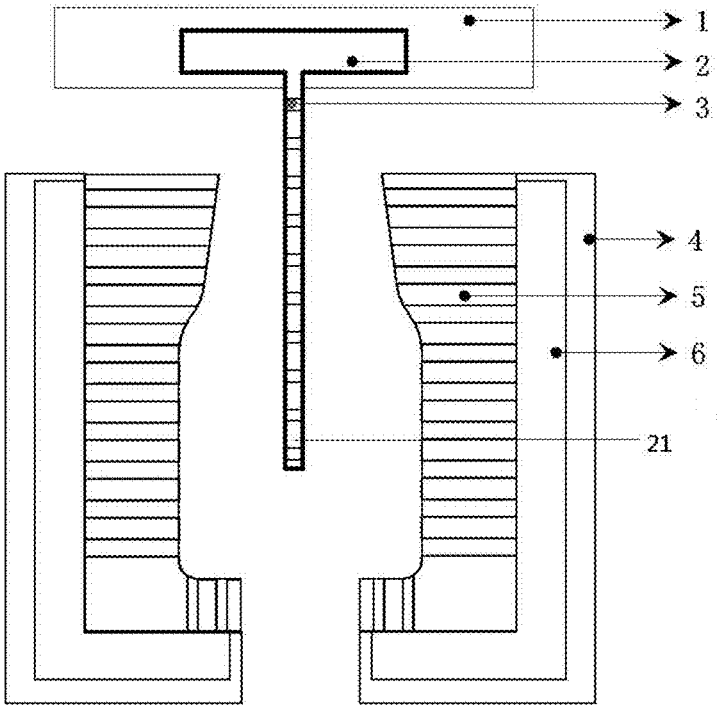
FIGS. 1A-1B show structural diagrams of a pulp injection system of the present disclosure.
Figure 1B:
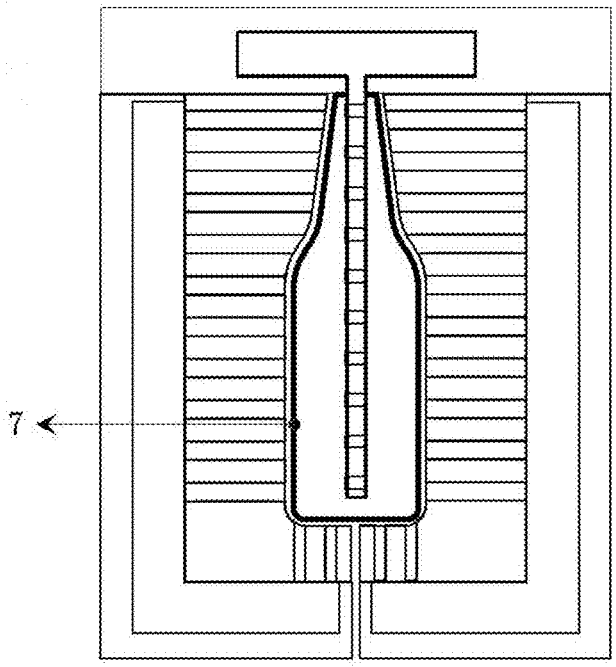

FIG. 1A and FIG. 1B show structural diagrams of a pulp injection system in a mold opening state and a mold closing state of the present disclosure. Parts denoted by 1-5 are structurally combined to form a mold of the pulp injection system. A pulp suction system specifically includes a pulp injection mold plate 1, a pulp injection cavity 2, and a pulp suction mold plate 4. The pulp suction mold plate 4 is provided with a cavity the same as the bottle in shape, and is composed of half pulp suction mold plates. The pulp injection mold plate 1 is located above the cavity and connected to the pulp injection cavity 2. A bottle cavity is formed by the pulp injection mold plate 1 and the pulp suction mold plate 4. The pulp injection cavity 2 has an extension portion 21 provided with pulp injection orifices 3 and extending into the cavity of the pulp suction mold plate 4, and a wet bottle preform 7 is preliminarily formed by injecting pulp via the pulp injection orifices 3. The pulp suction mold plate is provided with pulp suction holes 5 and a pulp suction cavity 6. The pulp suction holes 5 are formed in a peripheral surface of the cavity and communicate with the pulp suction cavity 6. The pulp suction holes 5 respectively correspond to a bottle mouth part, a bottleneck part, a bottle body part, and a bottle bottom part of the bottle cavity. The pulp suction holes at the bottle mouth part, the pulp suction holes at the bottleneck part, and the pulp suction holes at the bottle body part are higher in density than the pulp suction holes at the bottle bottom part. The pulp suction cavity 6 is connected to vacuum equipment (not shown). In the mold closing state, sugarcane pulp is sprayed to the bottle cavity from the pulp injection cavity 2 via the pulp injection orifices 3 in the extension portion 21, such that sufficiency and evenness of the pulp in the bottle cavity are achieved. The vacuum equipment (not shown) is started to perform vacuum pumping in the pulp suction cavity 6, such that the pulp is evenly attached to a surface of a pulp suction mold to form the wet bottle preform 7 subjected to pulp suction. The vacuum pumping is performed by about 0.7 MPa under the control of an electromagnetic valve and a pressure gauge, so that the moisture content of the wet bottle preform 7 is controlled to be 70%-80% and the thickness of the wet bottle preform 7 is controlled to be about 2.5 mm.

Figure 2A:
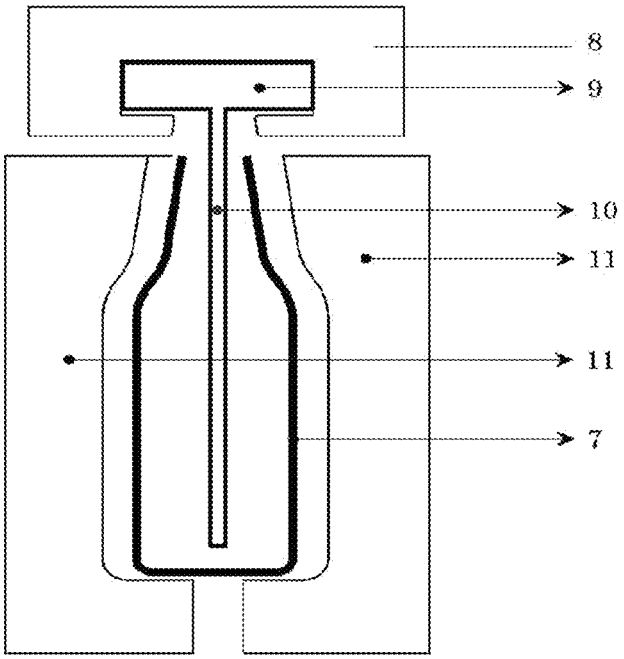
FIGS. 2A-2B show structural diagrams of a pulp suction system of the present disclosure.
Figure 2B:
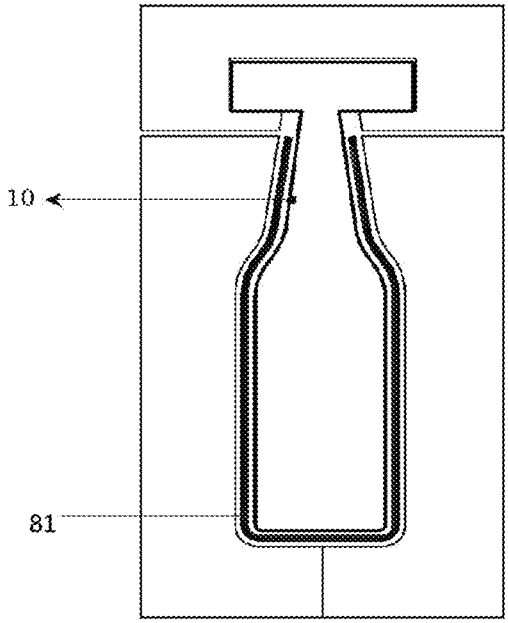

FIG. 2A and FIG. 2B show structural diagrams of the pulp suction system in a mold opening state and a mold closing state of the present disclosure. An extrusion system is composed of an extrusion die 8, a pressurizing cavity 9, an elastomer bag 10, the pulp suction mold 11, and the wet bottle preform 7 subjected to the pulp suction. The pressurizing cavity 9 is formed in the extrusion die 8 and communicates with the elastomer bag 10. A bottle cavity is formed by the extrusion die 8 and the pulp suction mold 11 below the extrusion die 8. The wet bottle preform 7 subjected to the pulp suction is stored in the bottle cavity, and the elastomer bag 10 extends into the wet bottle preform 7 in the bottle cavity. In the mold closing state, the elastomer bag is expanded by being pressurized to extrude the wet bottle preform, such that the wet bottle preform is attached to an inner wall of the bottle cavity to obtain a premolded pulp-molded bottle 81. The elastomer bag 10 as a retractable elastomer is filled with air to pressurize the mold for molding. After the molding is completed, the elastomer bag 10 is taken out after the air in the elastomer bag 10 is released. From the mold closing state, the wet bottle preform 7 subjected to the pulp suction is premolded by pressurization of the elastomer. The pressure from the elastomer bag is controlled to be 1 kgf, so that the moisture content of the premolded pulp-molded bottle is 40%-50%, and the thickness of the premolded pulp-molded bottle is 1.5 mm.

Figure 3A:
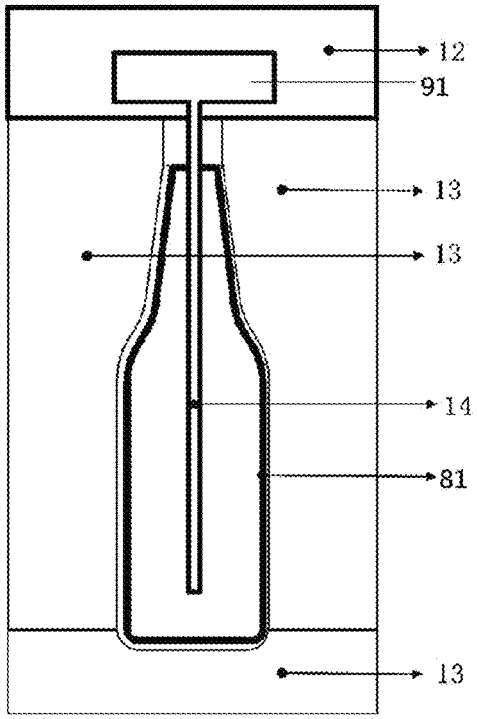
FIGS. 3A-3B show structural diagrams of a hot-press molding system of the present disclosure.
Figure 3B:
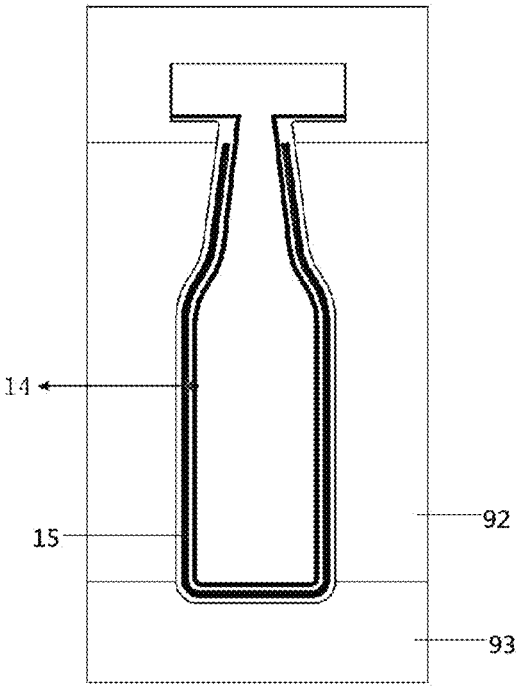

FIG. 3A and FIG. 3B show structural diagrams of a hot-press molding system in a mold opening state and a mold closing state of the present disclosure. An upper hot-press mold 12 includes an elastomer of an elastomer bag 14, which has high temperature resistance and high pressure resistance. A lower hot-press mold 13 includes two bottle body parts 92 and a bottle bottom part 93. The hot-press molding system is composed of the upper hot-press mold 12, a pressurizing cavity 91, the elastomer bag 14, the lower hot-press mold 13, and the premolded pulp-molded bottle 81. The pressurizing cavity 91 is formed in the upper hot-press mold 12 and communicates with the elastomer bag 14. A bottle cavity is formed by the upper hot-press mold 12 and the lower hot-press mold 13 below the upper hot-press mold 12. The premolded pulp-molded bottle 81 is stored in the bottle cavity. The elastomer bag 14 extends into the premolded pulp-molded bottle in the bottle cavity. Exhaust grooves are formed in the upper hot-press mold 12 and the lower hot-press mold 13. In the mold closing state, the upper hot-press mold 12 is filled with air to be pressurized, so that an integral pulp-molded bottle 15 is molded by deformation of the elastomer. The integral pulp-molded bottle is heated to 150° C. by the hot-press mold, the pressure from the elastomer bag is about 5 kgf, and excess water is discharged via the exhaust grooves, so that the moisture content of a finished integral pulp-molded bottle 15 is 3%-5%, and the thickness of the finished integral pulp-molded bottle 15 is about 1.0 mm. After the molding is completed, the elastomer bag 14 is taken out after the air in the elastomer bag 14 is released.

Embodiment 2

FIG. 1A and FIG. 1B show structural diagrams of a pulp injection system in a mold opening state and a mold closing state of the present disclosure. Parts denoted by 1-5 are structurally combined to form a mold of the pulp injection system. A pulp suction system specifically includes a pulp pouring mold plate 1, a pulp pouring cavity 2, and a pulp suction mold plate 4. The pulp suction mold plate 4 is provided with a cavity the same as a bottle in shape, and is composed of half pulp suction mold plates. The pulp pouring mold plate 1 is located above the cavity and connected to the pulp pouring cavity 2; and a bottle cavity is formed by the pulp pouring mold plate 1 and the pulp suction mold plate 4. The pulp pouring cavity 2 has an extension portion 21 provided with a pulp pouring hole 3 and extending into the cavity of the pulp suction mold plate 4, and a wet bottle preform 7 is preliminarily formed by injecting pulp via the pulp pouring hole 3. The pulp suction mold plate is provided with pulp suction holes 5 and a pulp suction cavity 6. The pulp suction holes 5 are formed in a peripheral surface of the cavity and communicate with the pulp suction cavity 6; the pulp suction holes 5 respectively correspond to a bottle mouth part, a bottleneck part, a bottle body part, and a bottle bottom part of the bottle cavity; and the pulp suction holes at the bottle mouth part, the pulp suction holes at the bottleneck part, and the pulp suction holes at the bottle body part are higher in density than the pulp suction holes at the bottle bottom part. The pulp suction cavity 6 is connected to vacuum equipment (not shown). In the mold closing state, bamboo pulp is poured to corresponding parts of the bottle cavity by pressurization from the pulp pouring cavity 2 via the pulp pouring hole 3 in the extension portion 21, such that sufficiency and evenness of the pulp in the bottle cavity are achieved. The vacuum equipment (not shown) is started to perform vacuum pumping in the pulp suction cavity 6, such that the pulp is evenly attached to a surface of a pulp suction mold to form the wet bottle preform 7 subjected to pulp suction. The vacuum pumping is performed by about 0.7 MPa under the control of an electromagnetic valve and a pressure gauge, so that the moisture content of the wet bottle preform 7 is controlled to be 70%-80%, and the thickness of the wet bottle preform 7 is controlled to be about 2.5 mm.

FIG. 2A and FIG. 2B show structural diagrams of the pulp suction system in a mold opening state and a mold closing state of the present disclosure. An extrusion system is composed of an extrusion die 8, a pressurized cavity 9, an elastomer bag 10, the pulp suction mold 11, and the wet bottle preform 7 subjected to the pulp suction. The pressurizing cavity 9 is formed in the extrusion die 8 and communicates with the elastomer bag 10. A bottle cavity is formed by the extrusion die 8 and the pulp suction mold 11 below the extrusion die 8. The wet bottle preform 7 subjected to the pulp suction is stored in the bottle cavity, and the elastomer bag 10 extends into the wet bottle preform 7 in the bottle cavity. In the mold closing state, the elastomer bag is expanded by being pressurized to extrude the wet bottle preform, such that the wet bottle preform is attached to an inner wall of the bottle cavity to obtain a premolded pulp-molded bottle 81. The elastomer bag 10 as a retractable elastomer is filled with air to pressurize the mold for molding. After the molding is completed, the elastomer bag 10 is taken out after the air in the elastomer bag 10 is released. From the mold closing state, the wet bottle preform 7 subjected to the pulp suction is premolded by pressurization of the elastomer. The pressure from the elastomer bag is controlled to be 1 kgf, so that the moisture content of the premolded pulp-molded bottle is 40%-50%, and the thickness of the premolded pulp-molded bottle is 1.5 mm.

FIG. 3A and FIG. 3B show structural diagrams of a hot-press molding system in a mold opening state and a mold closing state of the present disclosure. An upper hot-press mold 12 includes an elastomer of an elastomer bag 14, which has high temperature resistance and high pressure resistance. A lower hot-press mold 13 includes two bottle body parts 92 and a bottle bottom part 93. The hot-press molding system is composed of the upper hot-press mold 12, a pressurizing cavity 91, the elastomer bag 14, the lower hot-press mold 13, and the premolded pulp-molded bottle 81. The pressurizing cavity 91 is formed in the upper hot-press mold 12 and communicates with the elastomer bag 14. A bottle cavity is formed by the upper hot-press mold 12 and the lower hot-press mold 13 below the upper hot-press mold 12. The premolded pulp-molded bottle 81 is stored in the bottle cavity. The elastomer bag 14 extends into the premolded pulp-molded bottle in the bottle cavity. Micropores of 0.1-0.01 mm are formed in the upper hot-press mold 12 and the lower hot-press mold 13 which are made from breathable steel. In the mold closing state, the upper hot-press mold 12 is filled with air to be pressurized, so that an integral pulp-molded bottle 15 is molded by deformation of the elastomer. The integral pulp-molded bottle is heated to 150° C. by the hot-press mold, the pressure from the elastomer bag is about 5 kgf, and excess water is discharged via the micropores in the breathable steel, so that the moisture content of a finished integral pulp-molded bottle 15 is 3%-5%, and the thickness of the finished integral pulp-molded bottle 15 is about 1.0 mm. After the molding is completed, the elastomer bag 14 is taken out after the air in the elastomer bag 14 is released.

Embodiment 3

FIG. 1A and FIG. 1B show structural diagrams of a pulp injection system in a mold opening state and a mold closing state of the present disclosure. Parts denoted by 1-5 are structurally combined to form a mold of the pulp injection system. A pulp suction system specifically includes a pulp injection mold plate 1, a pulp injection cavity 2, and a pulp suction mold plate 4. The pulp suction mold plate 4 is provided with a cavity the same as a bottle in shape and is composed of half pulp suction mold plates. The pulp injection mold plate 1 is located above the cavity and connected to the pulp injection cavity 2 as well as a pulp mixing and suction device (not shown) in the bottle. A bottle cavity is formed by the pulp injection mold plate 1 and the pulp suction mold plate 4. The pulp injection cavity 2 has an extension portion 21 provided with pulp injection orifices 3 and extending into the cavity of the pulp suction mold plate 4. A wet bottle preform 7 is preliminarily formed by injecting pulp via the pulp injection orifices 3. The pulp suction mold plate is provided with pulp suction holes 5 and a pulp suction cavity 6. The pulp suction holes 5 are formed in a peripheral surface of the cavity and communicate with the pulp suction cavity 6. The pulp suction holes 5 respectively correspond to a bottle mouth part, a bottleneck part, a bottle body part, and a bottle bottom part of the bottle cavity. The pulp suction holes at the bottle mouth part, the pulp suction holes at the bottleneck part, and the pulp suction holes at the bottle body part are higher in density than the pulp suction holes at the bottle bottom part. The pulp suction cavity 6 is connected to vacuum equipment (not shown). In the mold closing state, wood pulp is sprayed to the bottle cavity from the pulp injection cavity 2 via the pulp injection orifices 3 in the extension portion 21 and is evenly dispersed by means of the pulp mixing and suction device in the bottle, such that sufficiency and evenness of the pulp sprayed into the bottle cavity are achieved. The vacuum equipment (not shown) is started to perform vacuum pumping in the pulp suction cavity 6, such that the pulp is evenly attached to a surface of a pulp suction mold to form the wet bottle preform 7 subjected to pulp suction. The vacuum pumping is performed by about 0.7 MPa under the control of an electromagnetic valve and a pressure gauge, so that the moisture content of the wet bottle preform 7 is controlled to be 70%-80%, and the thickness of the wet bottle preform 7 is controlled to be about 2.5 mm.

FIG. 2A and FIG. 2B show structural diagrams of the pulp suction system in a mold opening state and a mold closing state of the present disclosure. An extrusion system is composed of an extrusion die 8, a pressurizing cavity 9, an elastomer bag 10, the pulp suction mold 11, and the wet bottle preform 7 subjected to the pulp suction. The pressurizing cavity 9 is formed in the extrusion die 8 and communicates with the elastomer bag 10. A bottle cavity is formed by the extrusion die 8 and the pulp suction mold 11 below the extrusion die 8. The wet bottle preform 7 subjected to the pulp suction is stored in the bottle cavity, and the elastomer bag 10 extends into the wet bottle preform 7 in the bottle cavity. In the mold closing state, the elastomer bag is expanded by being pressurized to extrude the wet bottle preform, such that the wet bottle preform is attached to an inner wall of the bottle cavity to obtain a premolded pulp-molded bottle 81. The elastomer bag 10 as a retractable elastomer is filled with water to pressurize the mold for molding. After the molding is completed, the elastomer bag 10 is taken out after the water in the elastomer bag 10 is discharged. From the mold closing state, the wet bottle preform 7 subjected to the pulp suction is premolded by pressurization of the elastomer. The pressure from the elastomer bag is controlled to be 1 kgf, so that the moisture content of the premolded pulp-molded bottle is 40%-50%, and the thickness of the premolded pulp-molded bottle is 1.5 mm.

FIG. 3A and FIG. 3B show structural diagrams of a hot-press molding system in a mold opening state and a mold closing state of the present disclosure. An upper hot-press mold 12 includes an elastomer of an elastomer bag 14, which has high temperature resistance and high pressure resistance. A lower hot-press mold 13 includes two bottle body parts 92 and a bottle bottom part 93. The hot-press molding system is composed of the upper hot-press mold 12, a pressurizing cavity 91, the elastomer bag 14, the lower hot-press mold 13, and the premolded pulp-molded bottle 81. The pressurizing cavity 91 is formed in the upper hot-press mold 12 and communicates with the elastomer bag 14. A bottle cavity is formed by the upper hot-press mold 12 and the lower hot-press mold 13 below the upper hot-press mold 12. The premolded pulp-molded bottle 81 is stored in the bottle cavity. The elastomer bag 14 extends into the premolded pulp-molded bottle in the bottle cavity. Exhaust grooves are formed in the upper hot-press mold 12 and the lower hot-press mold 13. In the mold closing state, the upper hot-press mold 12 is filled with air to be pressurized, so that an integral pulp-molded bottle 15 is molded by deformation of the elastomer. The integral pulp-molded bottle is heated to 150° C. by the hot-press mold, the pressure from the elastomer bag is about 5 kgf, so that the moisture content of a finished integral pulp-molded bottle 15 is 3%-5%, and the thickness of the finished integral pulp-molded bottle 15 is about 1.0 mm. After the molding is completed, the elastomer bag 14 is taken out after water in the elastomer bag 14 is discharged.

Embodiment 4

A pulp suction system specifically includes a pulp injection mold plate 1, a pulp injection cavity 2, and a pulp suction mold plate 4. The pulp suction mold plate 4 is provided with a cavity the same as a bottle in shape, and is composed of half pulp suction mold plates; the pulp injection mold plate 1 is located above the cavity and connected to the pulp injection cavity 2; and a bottle cavity is formed by the pulp injection mold plate 1 and the pulp suction mold plate 4. A wet bottle preform 7 is preliminarily formed by throwing pulp with a drum from the pulp injection cavity. The pulp suction mold plate is provided with pulp suction holes 5 and a pulp suction cavity 6. The pulp suction holes 5 are formed in a peripheral surface of the cavity and communicate with the pulp suction cavity 6; the pulp suction holes 5 respectively correspond to a bottle mouth part, a bottleneck part, a bottle body part, and a bottle bottom part of the bottle cavity; and the pulp suction holes at the bottle mouth part, the pulp suction holes at the bottleneck part, and the pulp suction holes at the bottle body part are higher in density than the pulp suction holes at the bottle bottom part. The pulp suction cavity 6 is connected to vacuum equipment (not shown). In the mold closing state, sugarcane pulp is thrown to be sprayed to the bottle cavity from the pulp injection cavity 2, such that sufficiency and evenness of the pulp in the bottle cavity are achieved. The vacuum equipment (not shown) is started to perform vacuum pumping in the pulp suction cavity 6, such that the pulp is evenly attached to a surface of a pulp suction mold to form the wet bottle preform 7 subjected to pulp suction. The vacuum pumping is performed by about 0.7 MPa under the control of an electromagnetic valve and a pressure gauge, so that the moisture content of the wet bottle preform 7 is controlled to be 70%-80%, and the thickness of the wet bottle preform 7 is controlled to be about 2.5 mm.

FIG. 2A and FIG. 2B show structural diagrams of the pulp suction system in a mold opening state and a mold closing state of the present disclosure. An extrusion system is composed of an extrusion die 8, a pressurizing cavity 9, an elastomer bag 10, the pulp suction mold 11, and the wet bottle preform 7 subjected to the pulp suction. The pressurizing cavity 9 is formed in the extrusion die 8 and communicates with the elastomer bag 10. A bottle cavity is formed by the extrusion die 8 and the pulp suction mold 11 below the extrusion die 8. The wet bottle preform 7 subjected to the pulp suction is stored in the bottle cavity, and the elastomer bag 10 extends into the wet bottle preform 7 in the bottle cavity. In the mold closing state, the elastomer bag is expanded by being pressurized to extrude the wet bottle preform, such that the wet bottle preform is attached to an inner wall of the bottle cavity to obtain a premolded pulp-molded bottle 81. The elastomer bag 10 as a retractable elastomer is filled with oil to pressurize the mold for molding. After the molding is completed, the elastomer bag 10 is taken out after the oil in the elastomer bag 10 is discharged. From the mold closing state, the wet bottle preform 7 subjected to the pulp suction is premolded by pressurization of the elastomer. The pressure from the elastomer bag is controlled to be 1 kgf, so that the moisture content of the premolded pulp-molded bottle is 40%-50%, and the thickness of the premolded pulp-molded bottle is 1.5 mm.

FIG. 3A and FIG. 3B show structural diagrams of a hot-press molding system in a mold opening state and a mold closing state of the present disclosure. An upper hot-press mold 12 includes an elastomer of an elastomer bag 14, which has high temperature resistance and high pressure resistance. A lower hot-press mold 13 includes two bottle body parts 92 and a bottle bottom part 93. The hot-press molding system is composed of the upper hot-press mold 12, a pressurizing cavity 91, the elastomer bag 14, the lower hot-press mold 13, and the premolded pulp-molded bottle 81. The pressurizing cavity 91 is formed in the upper hot-press mold 12 and communicates with the elastomer bag 14; a bottle cavity is formed by the upper hot-press mold 12 and the lower hot-press mold 13 below the upper hot-press mold 12; the premolded pulp-molded bottle 81 is stored in the bottle cavity; and the elastomer bag 14 extends into the premolded pulp-molded bottle in the bottle cavity. In the mold closing state, the upper hot-press mold 12 is filled with oil to be pressurized, so that an integral pulp-molded bottle 15 is molded by deformation of the elastomer. The integral pulp-molded bottle is heated to 150° C. by the hot-press mold, the pressure from the elastomer bag is about 5 kgf, and excess water is discharged, so that the moisture content of a finished integral pulp-molded bottle 15 is 3%-5%, and the thickness of the finished integral pulp-molded bottle 15 is about 1.0 mm. After the molding is completed, the elastomer bag 14 is taken out after the oil in the elastomer bag 14 is discharged.

Embodiment 5

In this embodiment of the present disclosure, an integral bottle is produced by combining a pulp-molded bottle shell with a plastic liner.

Figure 4:
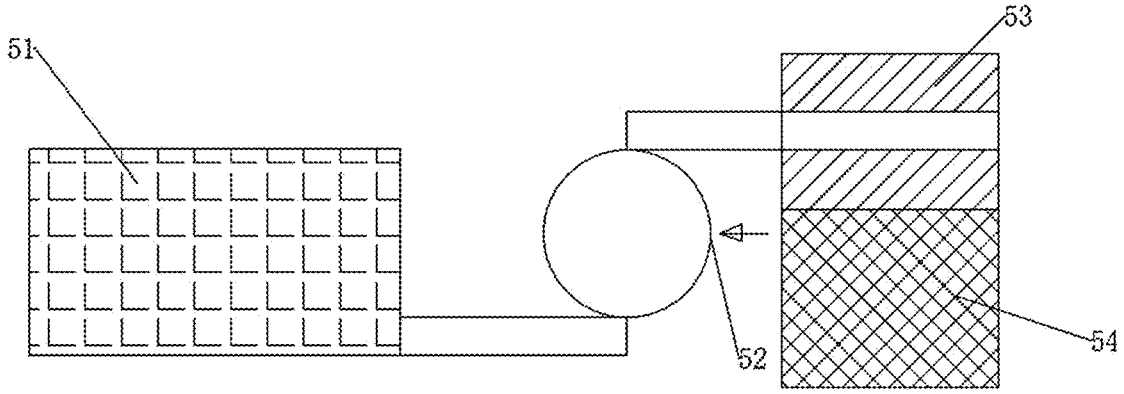
FIG. 4 shows an overall layout of an integral apparatus of the present disclosure.

As shown in FIG. 4, an apparatus includes an area 51 for molding a pulp-molded bottle shell, an area 52 for cutting the pulp-molded bottle shell, an area 54 for storing a plastic bottle preform, and an area 53 for performing loading of a liner. The area for molding the pulp-molded bottle shell includes a pulp suction area and a hot-press molding area. A wet bottle preform is molded in the pulp suction area, and an integral pulp-molded bottle shell is obtained after the wet bottle preform is molded in the hot-press molding area. A pulp-molded bottle having a standard size is cut in the area for cutting the pulp-molded bottle shell and combined with a plastic liner in the area for the loading of the liner; finally, the integral pulp-molded bottle is obtained.

Two approaches of pulp suction are adopted in the area for molding the pulp-molded bottle shell.

Figure 5:
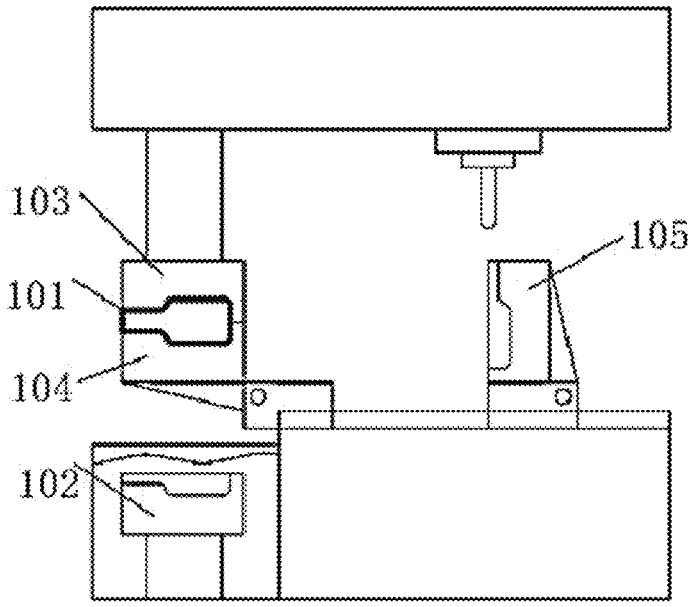
FIG. 5 shows a schematic diagram illustrating a transfer process of a wet bottle preform from a pulp suction mold to a hot-press mold during molding of a pulp-molded bottle shell of the present disclosure.
Figure 8:
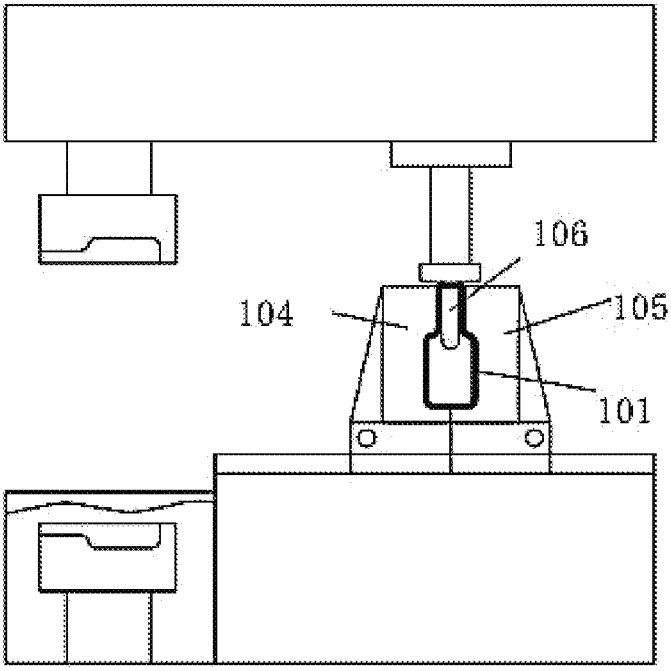
FIG. 8 shows a schematic diagram illustrating hot-press molding of the wet bottle preform during the molding of the pulp-molded bottle shell of the present disclosure.
Figure 9:
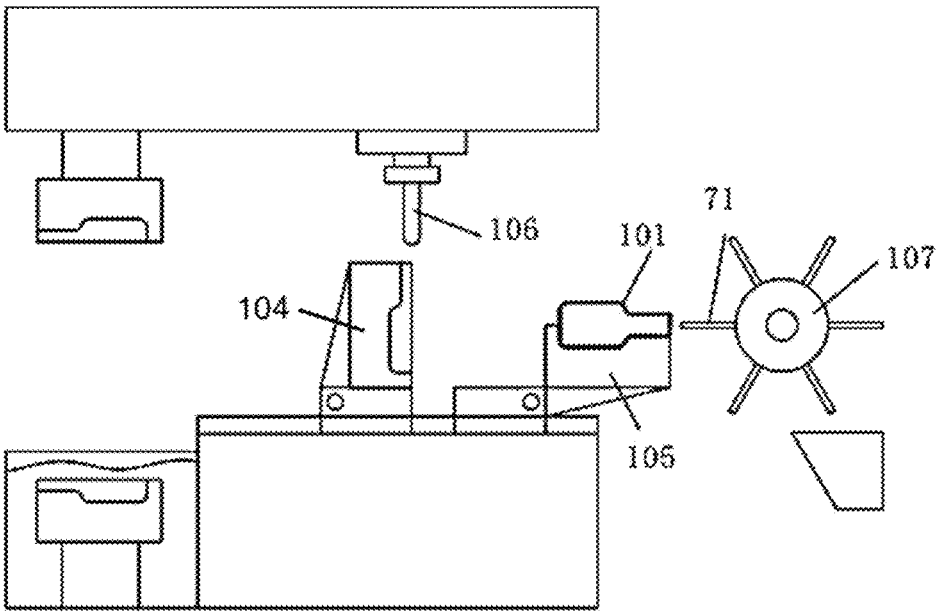
FIG. 9 shows a schematic diagram illustrating a transfer process of a dried shell from a hot-press mold to a next procedure during the molding of the pulp-molded bottle shell of the present disclosure.

Approach 1 of the pulp suction is as follows: the apparatus is provided with two pulp suction molds. As shown in FIG. 5, at an initial stage, the pulp suction mold 102 is located in a pulp pool. During operation, the pulp suction mold 103 moves downwards to be combined with the pulp suction mold 102, so as to form an integral pulp suction mold, and the pulp suction is performed by vacuum pumping. After a wet pulp-molded bottle preform in the integral pulp suction mold is molded, the integral pulp suction mold moves upwards to be above a level surface of the pulp pool. The pulp suction mold 102 stops being subjected to vacuum pumping, and the pulp suction mold 103 is kept subjected to the vacuum pumping. Then, the two pulp suction molds are separated. The pulp suction mold 102 moves downwards to an initial position, and the wet pulp-molded bottle preform 101 is retained in the pulp suction mold 103. As shown in FIG. 5, at this time, a hot-press mold 104 moves towards the pulp suction mold 103 along a slide rail and turns from a vertical direction to a horizontal direction. The pulp suction mold 103 moves downwards to make contact with the hot-press mold 104. The pulp suction mold 103 stops being subjected to the vacuum pumping, and the hot-press mold 104 starts to be subjected to the vacuum pumping, such that the wet pulp-molded bottle preform 101 is transferred into the hot-press mold 104. Then the hot-press mold 104 returns to an original position along the slide rail to make contact with a hot-press mold 105. As shown in FIG. 8, an extrusion die moves downwards until an elastic component 106 enters the bottle. A pressurizing cavity is formed in the extrusion die filled with high-temperature liquid. The high-temperature liquid is filled into the elastic component by pressurization; in this way, the elastic component is expanded to be enlarged, so that the wet pulp-molded bottle preform 101 is closely attached to an inner cavity of an integral hot-press mold to be set, and is dried by means of high temperature of the elastic component and high temperature of the integral hot-press mold. After the moisture content of the pulp-molded bottle reaches the standard, the pressurizing cavity of the extrusion die stops performing the pressurization; in this way, the high-temperature liquid flows back, the elastic component shrinks, and the extrusion die rises and leaves the integral hot-press mold to return to an original position. As shown in FIG. 9, the hot-press mold 105 starts to be subjected to the vacuum pumping, and thus is separated from the hot-press mold 104. The hot-press mold 105 turns from the vertical direction to the horizontal direction and moves towards a roller along the slide rail until a tooth bar 71 of the roller 107 extends into the pulp-molded bottle preform 101 by a certain distance. The roller 107 drives the pulp-molded bottle preform to rotate and takes the pulp-molded bottle preform to a conveyor belt. The hot-press mold 105 returns to an original position along the slide rail and continues to be combined with the hot-press mold 104 for production.

Figure 6:
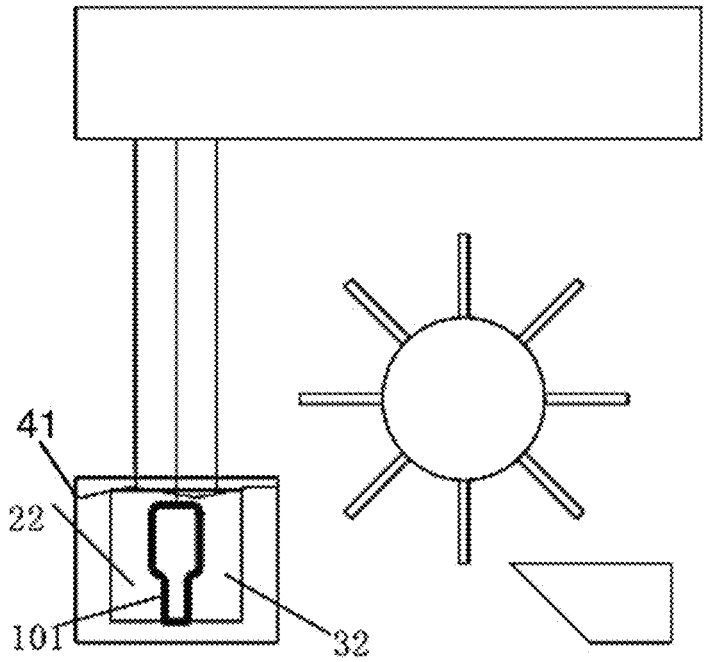
FIG. 6 shows a schematic diagram of a pulp suction process adopting approach 2 of pulp suction of the present disclosure.
Figure 7:
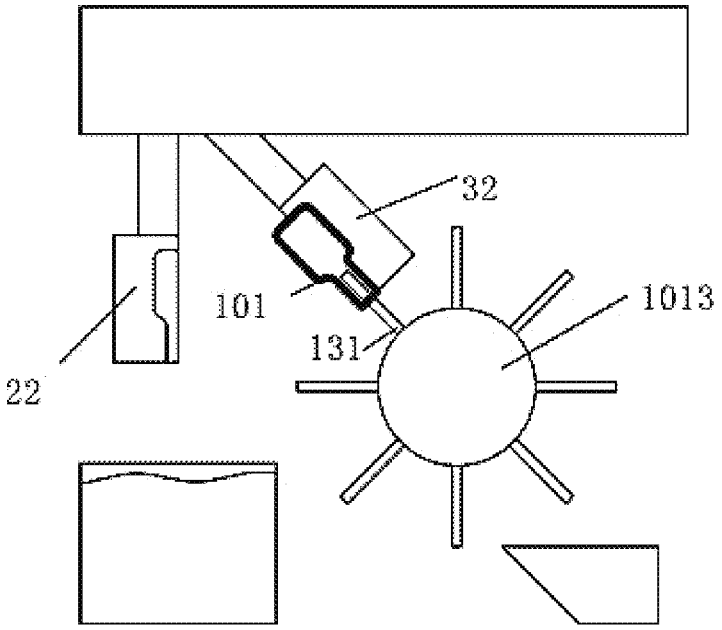
FIG. 7 shows a schematic diagram of a transfer process adopting approach 2 of the pulp suction, of the wet bottle preform of the present disclosure.

Approach 2 of the pulp suction is as follows: As shown in FIG. 6, two pulp suction molds 22 and 32 are configured; at the initial stage, the two pulp suction molds combined with each other are located above the pulp pool 41. After the operation is started, an integral pulp suction mold moves downwards to be immersed in the pulp pool. The two pulp suction molds start to be subjected to the vacuum pumping until a wet bottle preform is molded. As shown in FIG. 7, two pulp suction molds move upwards and stop when reaching a designated position. A pulp suction mold 22 stops being subjected to the vacuum pumping, and a pulp suction mold 32 is kept subjected to the vacuum pumping, such that the pulp suction mold 32 anticlockwise rotates by 45°, and the two pulp suction molds are separated. The pulp suction mold 32 moves downwards in a 45° direction until a tooth bar 131 of a roller 1013 extends into the wet bottle preform 101. The pulp suction mold 32 stops being subjected to the vacuum pumping and is returned to an original position for next production.

Figure 10:
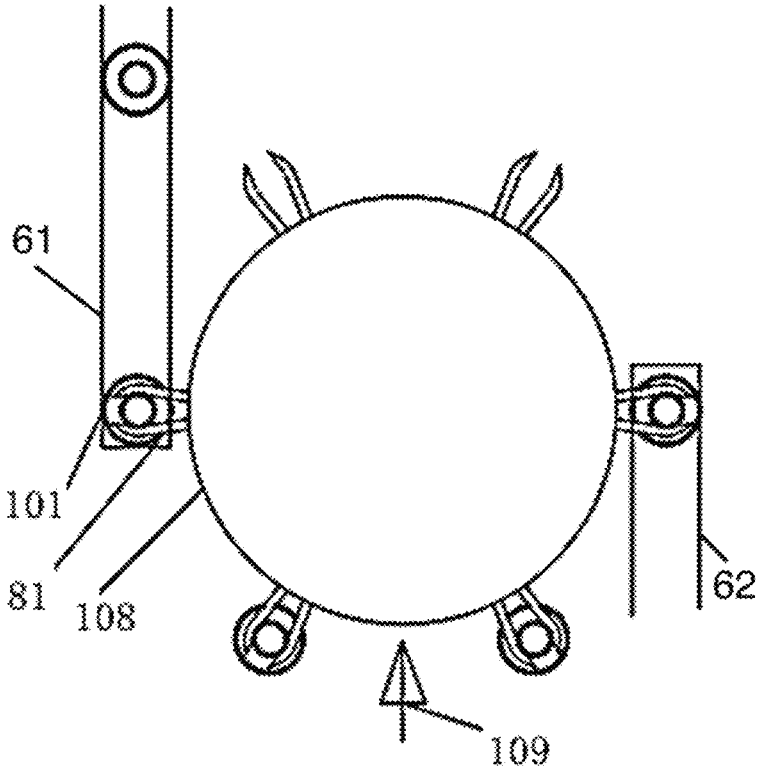
FIG. 10 shows a schematic diagram illustrating a cutting procedure of the pulp-molded bottle shell of the present disclosure.

The pulp-molded bottle is cut as follows:

As shown in FIG. 10, pulp-molded bottle shells 101 transferred to the conveyor belt 61 from a molding procedure are clamped by annularly arrayed mechanical arms 81 one by one, and the mechanical arm rotates to a cutting piece 109 to make the pulp-molded bottle shell 101 be cut to have a uniform height. The mechanical arm 81 puts the cut pulp-molded bottle shell 101 onto a next conveyor belt 62.

Figure 11:
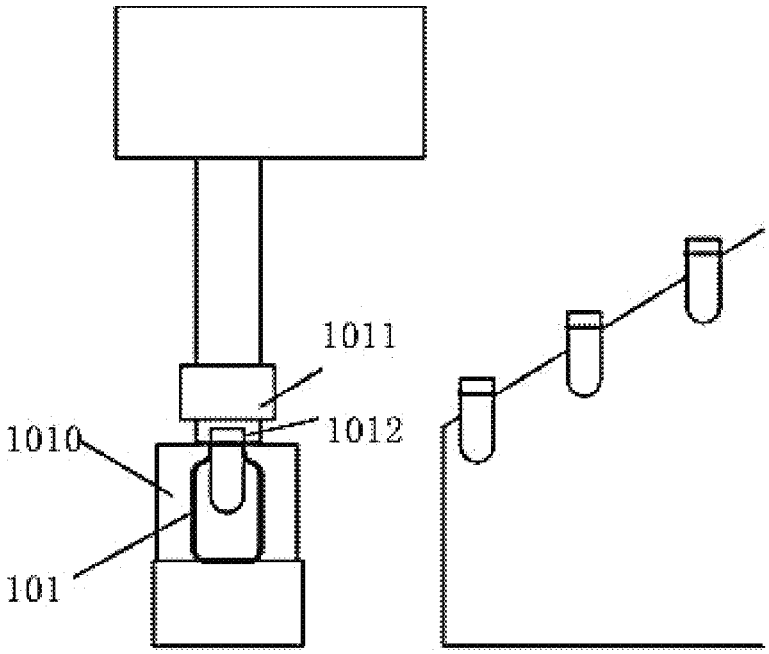
FIG. 11 shows a schematic diagram illustrating combination of a plastic liner and the pulp-molded bottle shell of the present disclosure.
Figure 12A:
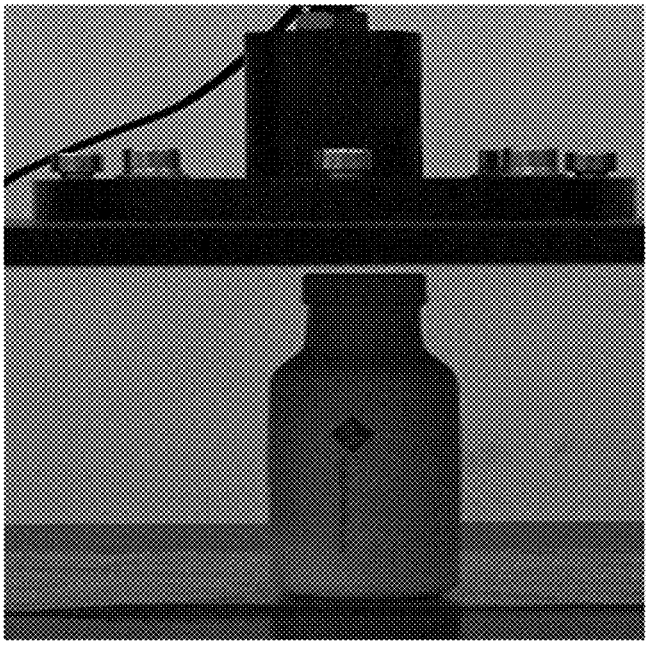
FIGS. 12A-12C show a pressure test on a bottle made in embodiment 5 of the present disclosure, where
Figure 12B:
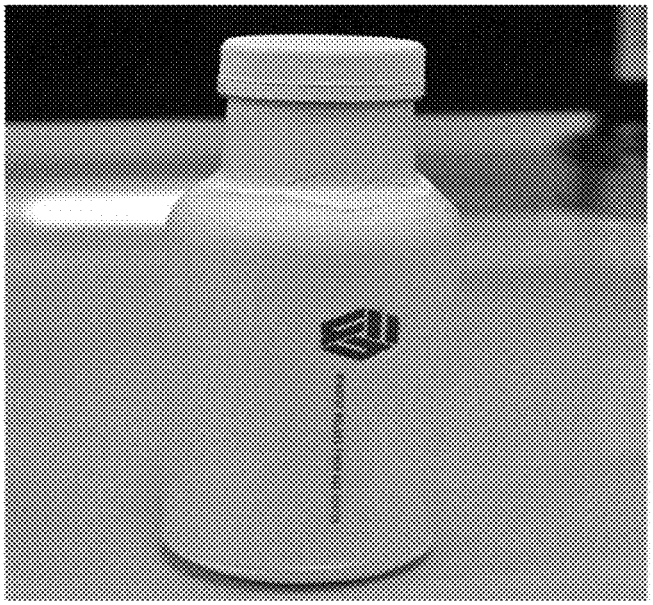
Figure 12C:
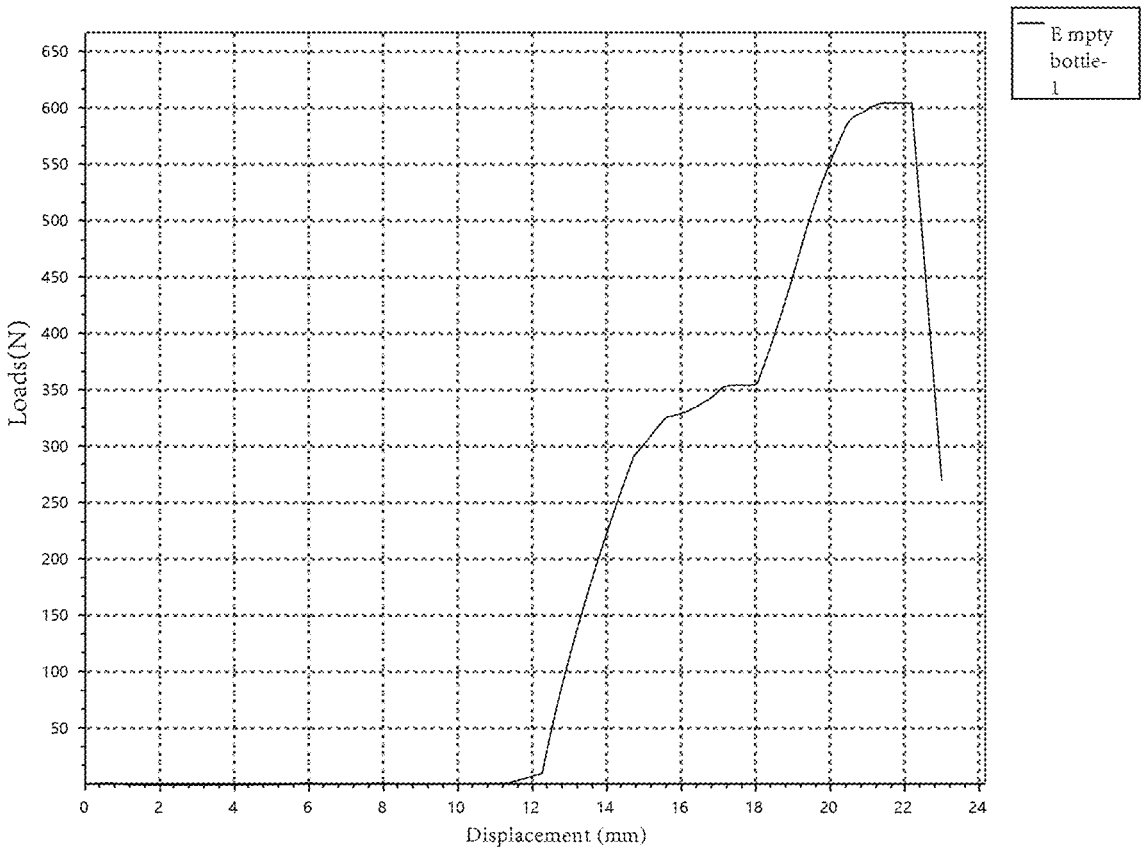
Figure 13A:
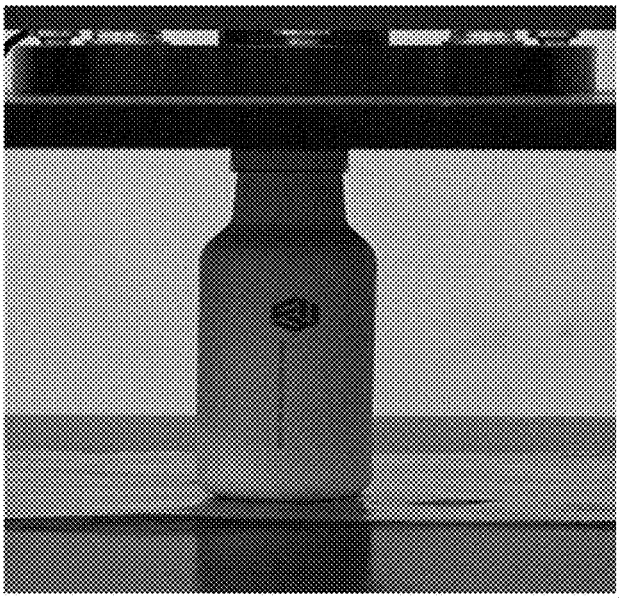
FIGS. 13A-13C show a pressure test on the bottle made in embodiment 5 of the present disclosure, where
Figure 13B:
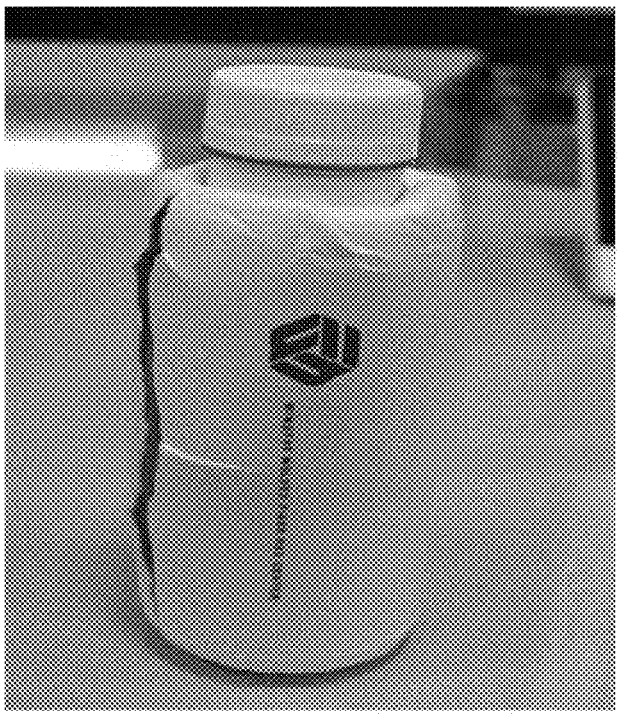
Figure 13C:
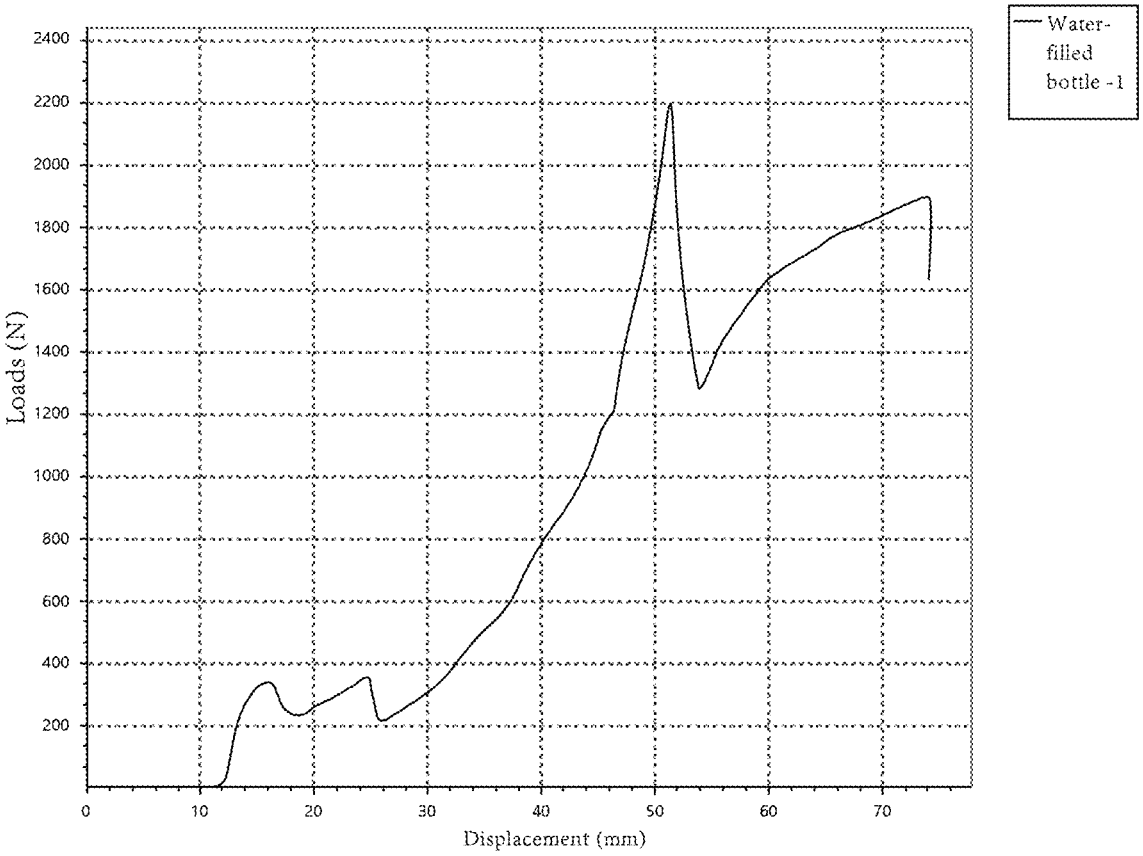

The liner is loaded as follows:

As shown in FIG. 11, the cut pulp-molded bottle shell 101 is conveyed to a liner loading procedure by the conveyor belt. After a certain number of pulp-molded bottle shells reach a designated position, blow molds 1010 on two sides of the pulp-molded bottle shell 101 are combined towards the pulp-molded bottle shell 101, such that the pulp-molded bottle shell 101 is located in an integral blow mold 1010. A premolded plastic bottle preform 1012 moves towards the integral blow mold along a corresponding rail after being preheated, and then is clamped by a blow molding head 1011 to enter the pulp-molded bottle shell and be positioned at a designated position, so as to make contact with the pulp-molded bottle shell for blow molding. Finished pulp-molded bottle products 101 are collected and stored.

The following table shows the results of a performance test on the integral bottle having the plastic liner and made in embodiment 5 of the present disclosure.

| Test items | Reference standard. | Test results |
|---|---|---|
| Pressure resistance of an empty bottle | >100N | Pass |
| Pressure resistance of a water-filled bottle | >100N | Pass |
| Falling 1.8 m | No leakage | Pass |
| Air tightness test | No leakage | Pass |
| Air pressure test | >10GV | Pass |
| High temperature 60° C. | No leakage | Pass |
| Low temperature −20° C. | No leakage | Pass |

The obtained pulp-molded bottle has the following structure: the pulp-molded bottle shell is made of 100% pulp-molded products to achieve excellent support strength, and the liner is made of 0.1-0.05 mm thick plastics to protect liquid and achieve safety (in the fields of foods, daily chemicals, and the like), so that the problem of liquid penetration caused by paper is solved, and the plastics are reduced by more than 70%.

The above description is merely preferred embodiments of the present disclosure and is not intended to limit the present disclosure, and various changes and modifications of the present disclosure may be made by those skilled in the art. Any modifications, equivalent substitutions, improvements, and the like made within the spirit and principle of the present disclosure should be included within the protection scope of the present disclosure.

What is claimed is:

1. A mold for molding an integral pulp-molded bottle shell, comprising a pulp suction system, an extrusion system, and a hot-press molding system, wherein the pulp suction system comprises a pulp injection mold plate, a pulp injection cavity, and a pulp suction mold plate;

the pulp suction mold plate is provided with a cavity, wherein the cavity is the same as the integral pulp-molded bottle in shape; the pulp injection mold plate is located above the cavity and the pulp injection mold plate is connected to the pulp injection cavity; the pulp injection cavity has an extension portion, the extension portion is provided with pulp injection orifices, the extension portion extends into the cavity of the pulp suction mold plate, and a pulp is injected via the pulp injection orifices; the pulp suction mold plate is provided with pulp suction holes and a pulp suction cavity; the pulp suction holes are formed in a peripheral surface of the cavity and the pulp suction holes communicate with the pulp suction cavity; and the pulp suction cavity is connected to a vacuum equipment to mold, by the vacuum pumping, a preliminary wet bottle preform is formed by the pulp injection into the pulp suction cavity subjected to the pulp suction;

the extrusion system is configured to form a premolded pulp-molded bottle by applying pressure to expand a first elastomer bag wherein the pressure applied to the first elastomer bag is controlled to be 1 kgf; and the hot-press molding system is configured to form an integral pulp-molded bottle by applying pressure to expand a second elastomer bag wherein the second elastomer bag has resistance to a temperature of 150° C. and resistance to a pressure of 5 kgf.

2. The mold according to claim 1, wherein a first bottle cavity is formed by the pulp injection mold plate and the pulp suction mold plate; the pulp suction mold plate comprises half pulp suction mold plates; and the extrusion system comprises an extrusion die, a first pressurizing cavity, the first elastomer bag, a pulp suction mold, and the wet bottle preform subjected to the pulp suction.

3. The mold according to claim 2, wherein the first pressurizing cavity is formed in the extrusion die and the first pressurizing cavity is connected to the first elastomer bag; a second bottle cavity is formed by the extrusion die and the pulp suction mold, wherein the pulp suction mold is below the extrusion die; the wet bottle preform subjected to the pulp suction is stored in the second bottle cavity; the first elastomer bag extends into the wet bottle preform stored in the second bottle cavity; and in a mold closing state, the first elastomer bag is expanded by being pressurized to extrude the wet bottle preform stored in the second bottle cavity to be attached to an inner wall of the second bottle cavity to form the premolded pulp-molded bottle.

4. The mold according to claim 2, wherein the first elastomer bag is filled with a high-pressure air, water, or an oil to be pressurized to apply a pressure to an inner cavity of the wet bottle preform subjected to the pulp suction for a dewatering and a premolding.

5. The mold according to claim 1, wherein the hot-press molding system comprises an upper hot-press mold, a second pressurizing cavity, the second elastomer bag, a lower hot-press mold, and the premolded pulp-molded bottle.

6. The mold according to claim 5, wherein the second pressurizing cavity is formed in the upper hot-press mold and the second pressurizing cavity is connected to the second elastomer bag; a third bottle cavity is formed by the upper hot-press mold and the lower hot-press mold, wherein the lower hot-press mold is below the upper hot-press mold; the premolded pulp-molded bottle is stored in the third bottle cavity; the second elastomer bag extends into the premolded pulp-molded bottle stored in the third bottle cavity; and in a mold closing state, the second elastomer bag is expanded by being pressurized to extrude the premolded pulp-molded bottle to be attached to an inner wall of the third bottle cavity to form the integral pulp-molded bottle.

7. An apparatus for producing a pulp-molded bottle having a plastic liner, comprising an area for molding a pulp-molded bottle shell, an area for cutting the pulp-molded bottle shell, an area for a plastic bottle preform, and an area for a loading of a liner, wherein the area for molding the pulp-molded bottle shell comprises the mold according to claim 1; and after a molding is completed, the integral pulp-molded bottle shell is formed;

a bottle preform of the plastic liner is molded in the area for the plastic bottle preform; and in the area for the loading of the liner, the integral pulp-molded bottle shell is located in a blow mold; and when the plastic bottle preform is put into the blow mold by a blow molding head for a blow molding, the plastic liner is directly attached in the pulp-molded bottle shell.

8. A process for producing an integral pulp-molded bottle shell by the mold according to claim 1, the method comprising the following steps:

(1) assembling the pulp suction system to make the pulp suction system be in a mold closing state, and injecting a pulp to a first bottle cavity from a pulp injection cavity via pulp injection orifices in an extension portion to achieve a sufficiency of the pulp and an evenness of the pulp in the first bottle cavity;

(2) starting a vacuum equipment to perform the vacuum pumping in a pulp suction cavity to make the pulp be evenly attached to a surface of a pulp suction mold to form the wet bottle preform subjected to the pulp suction;

(3) transferring the wet bottle preform subjected to the pulp suction to the extrusion system, and storing the wet bottle preform subjected to the pulp suction into a second bottle cavity; enabling the first elastomer bag to extend into the wet bottle preform stored in the second bottle cavity; and in the mold closing state, expanding the first elastomer bag by a pressurization to make the first elastomer bag extrude the wet bottle preform stored in the second bottle cavity to be attached to an inner wall of the second bottle cavity to form the premolded pulp-molded bottle; and (4) transferring the premolded pulp-molded bottle to the hot-press molding system, and storing the premolded pulp-molded bottle into a third bottle cavity; enabling the second elastomer bag to extend into the premolded pulp-molded bottle stored in the third bottle cavity; and in the mold closing state, expanding the second elastomer bag by the pressurization to make the second elastomer bag extrude the premolded pulp-molded bottle to be attached to an inner wall of the third bottle cavity to form the integral pulp-molded bottle by a hot-press molding.

9. The process according to claim 8, wherein in step (1), the pulp is injected by spraying, pouring, a suction in a mixing manner in a bottle, or throwing with a drum; and the pulp is selected from the group consisting of sugarcane pulp, bamboo pulp, and wood pulp; and in step (3) and step (4), a step of taking out the first elastomer bag and the second elastomer bag after pressurized air or liquid in the first elastomer bag and the second elastomer bag is released or discharged is further performed.

10. A process for producing a pulp-molded bottle having a plastic liner, comprising the following steps: making the integral pulp-molded bottle shell through the process according to claim 8; premolding a plastic bottle preform in an area for the plastic bottle preform; and in an area for a loading of a liner, storing the integral pulp-molded bottle into a blow mold, wherein when the plastic bottle preform is put into the blow mold by a blow molding head for a blow molding, the plastic bottle preform is directly attached in a pulp-molded bottle shell.

11. The process according to claim 8, wherein in the mold, the first bottle cavity is formed by the pulp injection mold plate and the pulp suction mold plate; the pulp suction mold plate comprises half pulp suction mold plates; and the extrusion system comprises an extrusion die, a first pressurizing cavity, the first elastomer bag, the pulp suction mold, and the wet bottle preform subjected to the pulp suction.

12. The process according to claim 11, wherein in the mold, the first pressurizing cavity is formed in the extrusion die and the first pressurizing cavity is connected to the first elastomer bag; the second bottle cavity is formed by the extrusion die and the pulp suction mold, wherein the pulp suction mold is below the extrusion die; the wet bottle preform subjected to the pulp suction is stored in the second bottle cavity; the first elastomer bag extends into the wet bottle preform stored in the second bottle cavity; and in the mold closing state, the first elastomer bag is expanded by being pressurized to extrude the wet bottle preform stored in the second bottle cavity to be attached to the inner wall of the second bottle cavity to form the premolded pulp-molded bottle.

13. The process according to claim 11, wherein in the mold, the first elastomer bag is filled with a high-pressure air, water, or an oil to be pressurized to apply a pressure to an inner cavity of the wet bottle preform subjected to the pulp suction for a dewatering and a premolding.

14. The process according to claim 8, wherein in the mold, the hot-press molding system comprises an upper hot-press mold, a second pressurizing cavity, the second elastomer bag, a lower hot-press mold, and the premolded pulp-molded bottle.

15. The process according to claim 14, wherein in the mold, the second pressurizing cavity is formed in the upper hot-press mold and the second pressurizing cavity is connected to the second elastomer bag; the third bottle cavity is formed by the upper hot-press mold and the lower hot-press mold, wherein the lower hot-press mold is below the upper hot-press mold; the premolded pulp-molded bottle is stored in the third bottle cavity; the second elastomer bag extends into the premolded pulp-molded bottle stored in the third bottle cavity; and in the mold closing state, the second elastomer bag is expanded by being pressurized to extrude the premolded pulp-molded bottle to be attached to the inner wall of the third bottle cavity to form the integral pulp-molded bottle.

* * * * *